US012397215B1

(12) United States Patent
Malcolm, III et al.

(10) Patent No.: US 12,397,215 B1
(45) Date of Patent: Aug. 26, 2025

(54) AVERSION THERAPY DEVICE AND METHOD

(71) Applicants: Richard J. Malcolm, III, San Clemente, CA (US); Roger J. Malcolm, San Clemente, CA (US)

(72) Inventors: Richard J. Malcolm, III, San Clemente, CA (US); Roger J. Malcolm, San Clemente, CA (US)

( * ) Notice: Subject to any disclaimer, the term of this patent is extended or adjusted under 35 U.S.C. 154(b) by 830 days.

(21) Appl. No.: 17/566,532

(22) Filed: Dec. 30, 2021

Related U.S. Application Data

(60) Provisional application No. 63/133,181, filed on Dec. 31, 2020.

(51) Int. Cl.
*A63B 69/00* (2006.01)
*A41B 11/00* (2006.01)
*A43B 7/00* (2006.01)

(52) U.S. Cl.
CPC ..... *A63B 69/00* (2013.01); *A41B 11/00* (2013.01); *A43B 7/00* (2013.01); *A41B 2400/32* (2013.01)

(58) Field of Classification Search
CPC ..... A63B 69/00; A41B 11/00; A41B 2400/32; A43B 7/00
USPC ..... 434/255
See application file for complete search history.

(56) References Cited

U.S. PATENT DOCUMENTS

| | | | | |
|---|---|---|---|---|
| 3,702,999 | A | 11/1972 | Gradisar | |
| 7,346,936 | B2 | 3/2008 | Vargas et al. | |
| 2006/0026740 | A1* | 2/2006 | Vargas | A41B 11/008 2/239 |
| 2010/0050322 | A1 | 3/2010 | Zagula | |
| 2011/0054368 | A1* | 3/2011 | Sanders | A61H 1/0266 601/118 |
| 2018/0235836 | A1* | 8/2018 | Green | A41B 11/02 |
| 2018/0310636 | A1 | 11/2018 | Kettenbach | |

* cited by examiner

*Primary Examiner* — Peter S Vasat
*Assistant Examiner* — Stephen Alvesteffer
(74) *Attorney, Agent, or Firm* — Charmasson, Buchaca & Leach, LLP

(57) ABSTRACT

A device which uses aversion therapy to train the user to avoid certain high-weight-bearing walking activities by employing a body-worn garment that includes a pressure sensor feedback module at the location of the undesirable pressure. For example, a sock can have a spur module located in the heel portion which includes relatively uncompressible poker that is driven into the sole of a users foot when sufficient pressure is applied to the heel.

14 Claims, 3 Drawing Sheets

AVERSION THERAPY DEVICE AND METHOD

PRIOR APPLICATION

This application claims the benefit of U.S. Provisional Patent Application Ser. No. 63/133,181, filed 202-12-31.

FIELD OF THE INVENTION

This invention relates to devices and methods for aiding patients during convalescence and in particular to training patients to avoid putting too much weight on their leg while walking.

BACKGROUND

There are many situations in which a patient should avoid placing too much weight on their leg or foot in order to speed up the healing process. Repeatedly exceeding a certain amount of weight on the leg or foot may damage the repair or injury, often leading to an unnecessary prolongation of healing.

In the past, an example of such a situation is a period of convalescence following a mold arthroplasty repair of the femoral head and vitalium cup or ball and socket joint in the hip. This operation involves separating the ball and socket and removing damaged or deteriorated material. An artificial cup is placed over the ball and it is placed back in the socket. Exercise and use of the hip joint helps the bones to develop a new layer of cartilage. Too much force or weight on the hip in the early stages of convalescence, however, can damage the ball or socket.

Further, during sleep, some patients forget their injuries and may try to prematurely walk without crutches, putting undue weight on the affected leg or foot.

One solution shown in Gradisar, U.S. Pat. No. 3,702,999 provides a shoe insert including an electronic pressure sensor and warning signal when the weight on the foot exceeds a certain predetermined threshold. However, many patients find it awkward to wear shoes during sleep. Further, the audible warning signal may unnecessarily wake up spouses during sleep and/or be embarrassing in public. Electronic devices may provide additional complexity challenges to users who may require skill at programming or otherwise adjusting their sensitivity, especially at a time when the user may not be clear-headed during convalescence while taking various mind altering medications. Further, some electronic devices may be prone to losses in power due to drained batteries and thus be inoperative when needed.

Therefore, there is a need for an apparatus which addresses one or more of the above identified inadequacies.

SUMMARY

The principal and secondary objects of the invention are to provide an improved walking aversion therapy device and method. These and other objects are achieved by providing a body worn foot garment including a pressure sensitive, mild pain sensation-inducing feature.

In some embodiments there is provided a device for training a person to avoid placing an undesirable amount of weight on their foot, said devices comprises: a fabric sock shaped and dimensioned to be worn intimately over a person's foot; and, a spur module fixed with respect to a sole portion of said sock.

In some embodiments said spur module comprises: a poker made of a relatively incompressible material having a durometer of at least 40 A on the Shore durometer scale.

In some embodiments poker comprises a convex surface oriented to press against a user's heel during use.

In some embodiments said poker comprises an insert contained within a pocket formed on an inside surface of said sole portion.

In some embodiments said spur module comprises an adhesive band carrying said poker.

In some embodiments said adhesive band comprises a medial depression shaped and dimensioned to intimately nest said poker therein.

In some embodiments said poker is used oriented to contact said user's foot in absence of a shoe.

In some embodiments said spur module comprises: a block of resiliently compressible material having an upper surface exposed to said persons foot; a cavity within said block having an upper aperture; a poker comprising an upwardly projecting blunted prong having a tip portion shaped to pass through said upper aperture.

In some embodiments said tip is located at a predetermined vertical position spaced a distance apart from said upper surface while said block is uncompressed.

In some embodiments said block is shaped and dimensioned to form an insole within said sock.

In some embodiments said cavity comprises and conical well.

In some embodiments an axial position of said prong is adjustable.

In some embodiments said poker comprises a threaded base threadedly engaged within a threaded receptacle fixed to said spur module.

In some embodiments there is provided a combination of a fabric sock shaped and dimensioned to be worn on a user's foot and an aversion therapy insole, wherein said insole comprises: a spur module fixed with respect to a sole portion of said sock; wherein said spur module comprises a poker oriented to press against the user's foot upon a sufficient force exerted upon an undersurface of said insole opposite said foot.

In some embodiments there is provided a device for permitting a patient to bear part of his weight on his foot but warning him when he places at least a predetermined weight on said foot comprising, sensing means for detecting a weight on said foot including means for adjusting the minimum weight which is detected by said sensing means to said predetermined weight, means for maintaining said sensing means in a predetermined position adjacent the bottom of said foot so that said sensing means will detect said predetermined weight when said patient bears said predetermined weight on said foot; and, a poker operably connected to said sensing means to signal said patient when said predetermined weight is placed on said foot.

In some embodiments said poker comprises a threaded base mounted within a correspondingly threaded receptor recessed in an underside of a block of resiliently compressible material, whereby turning said base moves said poker relatively with respect to said block.

In some embodiments said resilient block operates as sais sensing means by acting as a force detector disposed generally beneath the heel of said foot.

In some embodiments there is provided a method for training a user to avoid high stress walking, said method comprises: inserting a spur module within a sock; locating said spur module in the sole portion of said sock; wearing said sock upon a foot of said user; engaging in high stress walking by said user; activating said spur module in response to said engaging; wherein said activating comprises: forcing a poker into the sole of the foot of said user.

In some embodiments said method further comprises replacing a first poker have a first durometer with a second poker having a second durometer different from said first durometer.

The original text of the original claims is incorporated herein by reference as describing features in some embodiments.

DESCRIPTION OF THE EXEMPLARY EMBODIMENTS

Figure 1:
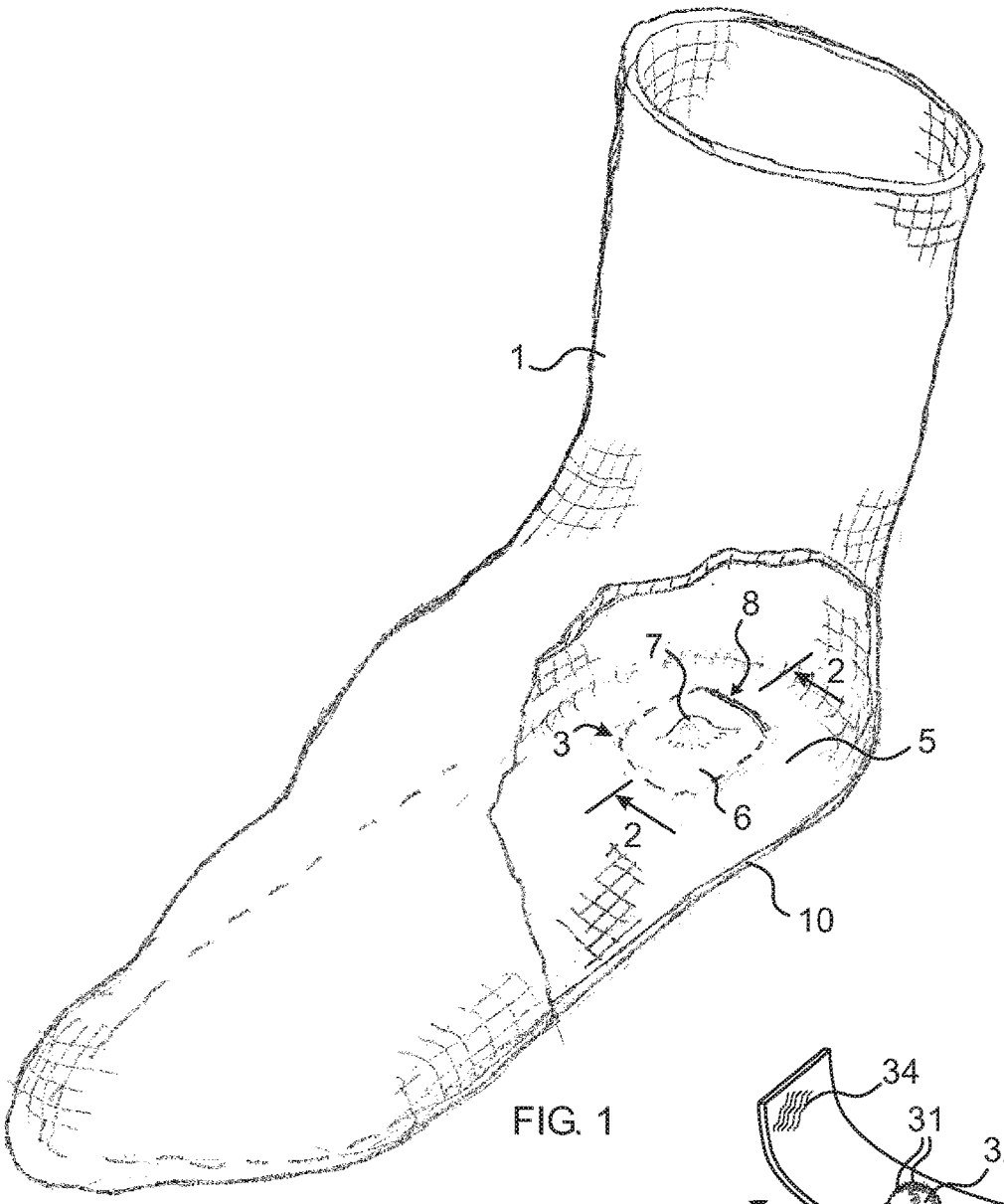
FIG. 1 is a diagrammatic perspective view of a body worn sock including a pressure sensitive mild pain sensation inducing spur module according to an exemplary embodiment of the invention.

In this specification, the references to top, bottom, upward, downward, upper, lower, vertical, horizontal, sideways, lateral, back, front, proximal, distal, etc. can be used to provide a clear frame of reference for the various structures with respect to other structures while the device is as shown in FIG. 1, and not treated as absolutes when the frame of reference is changed, such as when the device is inverted, disassembled, or the patient is laying down.

If used in this specification, the term "substantially" can be used with respect to manufacturing imprecision and inaccuracies that can lead to non-symmetricity and other inexactitudes in the shape, dimensioning and orientation of various structures. Further, use of "substantially" in connection with certain geometrical shapes and orientations, such as "parallel" and "perpendicular", can be given as a guide to generally describe the function of various structures, and to allow for slight departures from exact mathematical geometrical shapes, such as cylinders, disks and cones, and their orientations, while providing adequately similar function. Those skilled in the art will readily appreciate the degree to which a departure can be made from the mathematically exact geometrical references.

If used in this specification, the word "axial" is meant to refer to directions, movement, or forces acting substantially parallel with or along a respective axis, and not to refer to rotational nor radial nor angular directions, movement or forces, nor torsional forces.

In this specification the units "millimeter" or "millimeters" can be abbreviated "mm".

In this specification reference may be made to the use of numerous patches or layers of hook-and-vane fabric fastener such as VELCRO brand fastener available from Velcro USA Inc. of Manchester, New Hampshire in which a patch of hook-and-vane fabric fastener of a first type (either hook or vane) can releasably fasten to a patch of the opposite type. For example a patch of the hook type would releasably bond to a patch of the vane type or some other common, loosely woven fabrics. For clarity such fasteners are referred to in this specification as fabric fasteners, and a patch of fabric fastener will bond to a corresponding patch of fastener. Those skilled in the art will readily appreciate which type will best be used for any given patch and whether the type of matable patches can be swapped.

Figure 2:
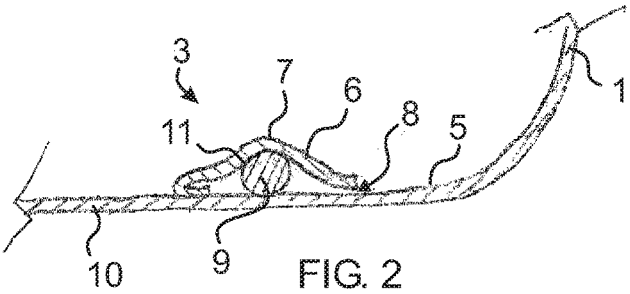
FIG. 2 is a diagrammatic cross-sectional side view of a spur module taken along line 2-2 of FIG. 1.

Referring now to the drawing, there is shown in FIGS. 1 and 2 a pliable fabric sock 1 shaped and dimensioned to be intimately worn on a person's foot. A bottom portion 10 of the sock is located to contact the sole of the wearer's foot. A spur module 3 can be formed on a part of the bottom portion. In this embodiment the spur module can be located to contact the wearer's heel. In this embodiment, the spur module can include a piece of fabric sewn onto the inner surface 5 of the bottom portion to form a pocket 6. The pocket can have an opening 8 through which can be inserted an insert 9 made from a relatively incompressible material such as steel or hard plastic to form a poker. The poker is thus formed by the insert within the pocket forming a relatively incompressible hump 7 located and oriented to contact the wearer's heel. When the wearer stands on a relatively hard surface such as the floor, the poker resists compression and pushes noticeably against the wearer's heel, causing a minor pain sensation. This unambiguously informs the wearer to stop applying such pressure to that foot.

The insert can be a solid body made of relatively incompressible material such as steel. For example the poker can be a metal ball such as a BB, ball bearing or glass marble. The term "relatively incompressible" is used in the context of the weight of a person being applied using that person's foot. A durometer of 20 A or more provides adequate incompressibility The insert 9 can be substantially spherical or other rounded shape to provide localized incompressibility without puncturing the skin. The insert can have a blunted, convex surface oriented to form the hump to press against the bottom of the user's heel during use. Of course, a sharpened spike or other shapes which could lead to the cutting of the heel are to be avoided. Thus there can be an absence of a sharp structure on the upper surface of the poker. The surface 11 of the insert can be substantially smooth as shown in FIG. 2 in order to facilitate insertion and extraction of the insert to and from the pocket 6. Depending on the weight of the patient, their heel callouses and other parameters, it may be useful to replace the insert with another insert having a different durometer.

Figure 3:
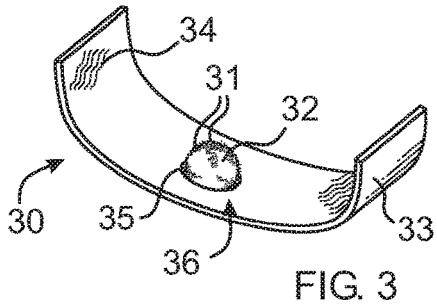
FIG. 3 is a diagrammatic perspective view of an alternate spur module using an adhesive band.

FIG. 3 shows an alternate embodiment of a device 30 for training a person to avoid placing an undesirable amount of weight on their foot. The device can include a band 33 of flexible sheet material such as fabric. An inner surface of the band can have an exposed layer of adhesive 34 for removably adhering the device to the heel of the user, or over a user's sock. A poker 36 can be formed on the upper surface of the device by an insert 32 secured within a depression 35 set into the inner surface of the band order to discourage inadvertent dislodging of the insert from the band.

The embodiment of FIG. 3 further shows that the surface of the insert 32 can have asperities 31 in order to cause greater discomfort for a given amount of pressure. The dimensioning of the asperities should be selected so that none are long enough to puncture the skin of the heel. The roughened surface can also facilitate securing the position of the insert within the pocket of the device of FIG. 2.

Figure 4:
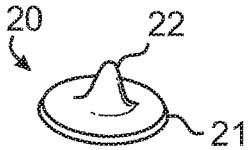
FIG. 4 is a diagrammatic perspective view of an alternate poker formed to have a disk-shaped base and central prong.

FIG. 4 shows that an alternate insert 20 can be shaped and dimensioned to have a disk-shaped base 21 and a central prong 22 similar to a dulled, worn spike for a golf shoe. The advantage of this shape is that the larger surface area of the base will tend to secure and stabilize the insert upon the adhesive coated band 33 and avoid the need for the securing depression 35 on the inner surface of the band.

Figure 5:
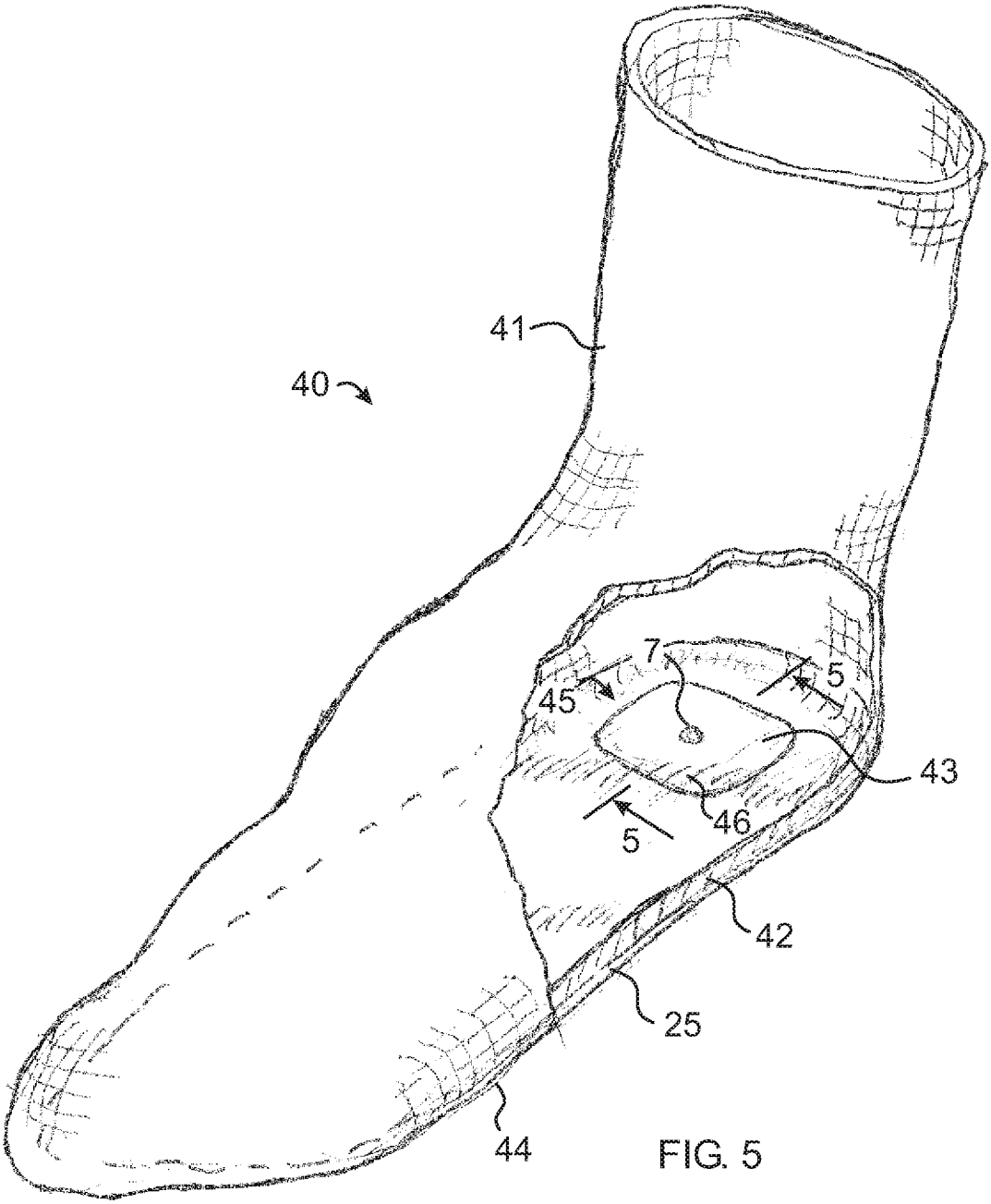
FIG. 5 is a diagrammatic perspective view of a body worn sock including a pressure sensitive mild pain sensation inducing spur module located in an insole according to an alternate exemplary embodiment of the invention.
Figure 6:
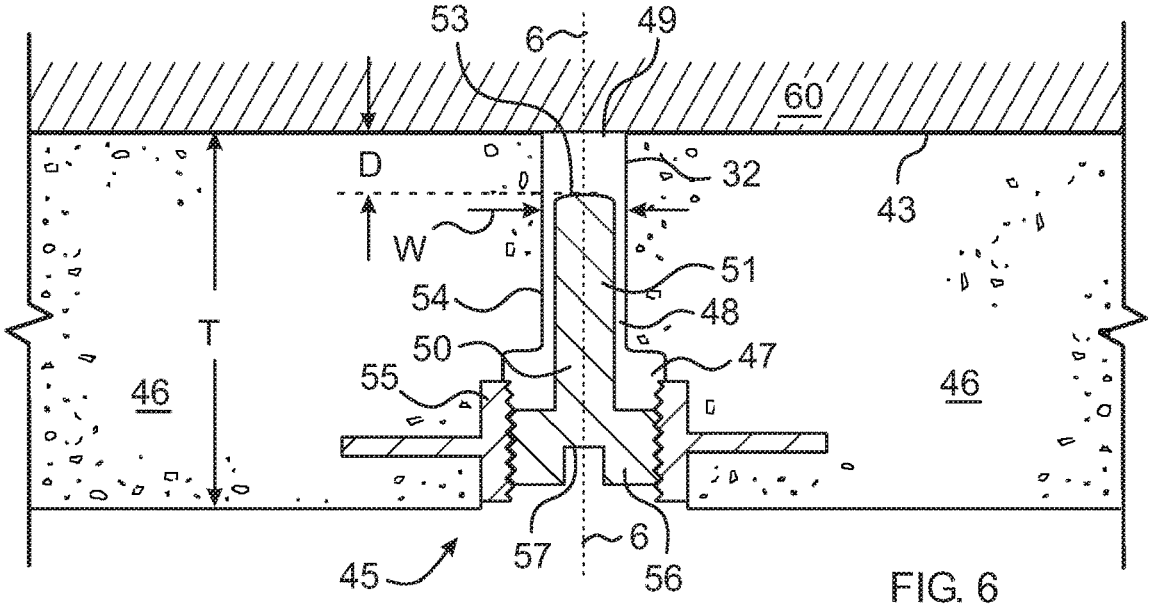
FIG. 6 is a diagrammatic cross-sectional side view of a spur module taken along line 5-5 of FIG. 5 in an uncompressed state.
Figure 7:
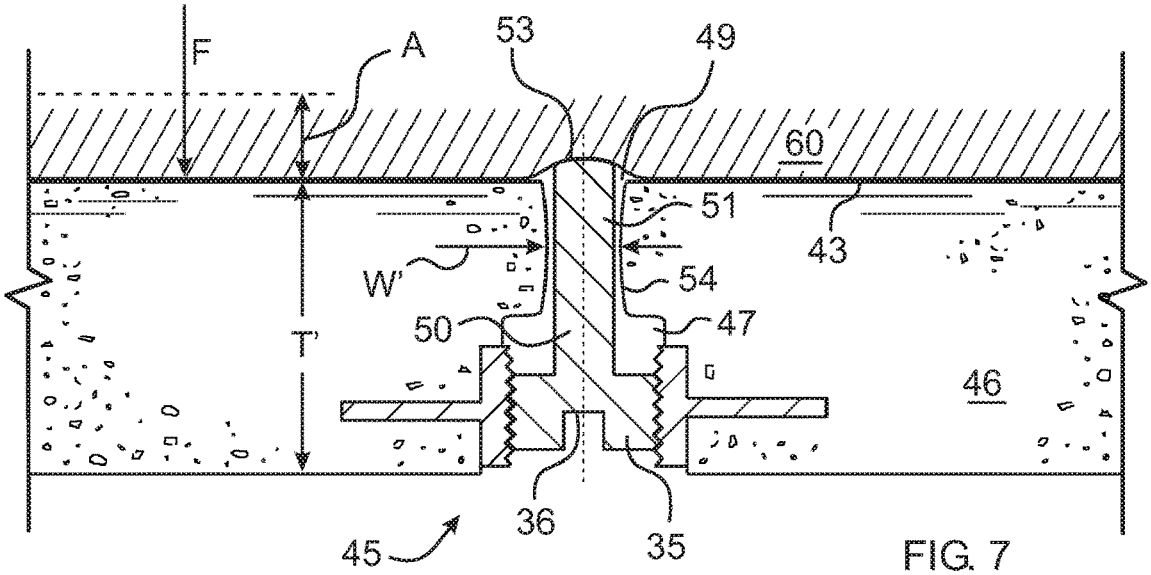
FIG. 7 is a diagrammatic cross-sectional side view of the spur module of FIG. 6 in a compressed state.

FIGS. 5-7 show an alternate embodiment of a device 40 for training a person to avoid placing an undesirable amount of weight on their foot. In this embodiment the device includes a pliable fabric sock 41 that can be shaped and dimensioned to be intimately worn on a person's foot. An insole 42 made from resilient material, such as sponge rubber, is located on the bottom sole portion 44 of the sock and oriented to contact the sole of the wearer's foot. A bottom layer 25 of hook type hook-and-vane fastener allows the insole to releasably secure to the inner surface of the sole portion of the sock. A spur module 45 can be formed on a part of the insole vertically adjacent to the bottom of the wearer's heel 60. In this embodiment, the spur module can comprise a block 46 of material having a similar resiliency to the insole material. Alternately, the block can be integral with the insole.

As shown in FIG. 6, the spur module 45 can further comprise a cavity 47 formed into the block 46. The cavity can include a substantially vertical, oblong well 48 extending along a substantially vertical axis 6 and having a substantially cylindrical sidewall 54 terminating in an upper aperture 49 through the upper surface 43 of the block. A poker 50 made of solid, rigid, relatively incompressible material such as steel or hard plastic can reside primarily within the cavity. The poker can include a substantially vertical, substantially cylindrical prong 51 extending upwardly through the well 48. The upper aperture is dimensioned to allow passage of the tip 53 of the prong therethrough as the block is compressed. Thus, the well can have a diameter larger than a diameter of the prong.

As shown in FIG. 6 the block 46 it in its resting, uncompressed state can have a vertical thickness T, where the tip 53 of the prong 51 resides a distance D below the level of the aperture 49 in the upper surface 43 of the block. In this way the prong is fully retracted and contained within the cavity 47 and there is no contact between the prong and the bottom of the wearer's heel 60.

As shown in FIG. 7, when sufficient weight is placed on the foot, the heel 60 presses down with a force F on the upper surface 43 of the block 46 thereby compressing it so that it has a vertical thickness T' which is less than its uncompressed thickness T. The difference is the distance A which the upper surface has moved downward. This compressing of the block causes the tip 53 of the prong 51 to protrude above the horizontal level of the aperture 49 and contact the user's heel, and push upwardly into it, causing a mild pain sensation indicating to the user to stop putting weight on the foot. The prong can have a rounded blunted tip 53 so that forceful contact with the tip is not likely to puncture the skin of the heel.

It shall be understood that care must be taken when selecting the size and shape of the well 48 so that the prong 51 can pass through the well unimpeded when the material surrounding the well is compressed, causing the well to narrow. For example, in its uncompressed state shown in FIG. 6 the well can have a width W, whereas in its compressed state shown in FIG. 7, the sidewall 54 of the well can collapse inwardly so that the well can have a width W' that is significantly small than the uncompressed width W. Thus the uncompressed width of the well should be selected to be oversized to a degree necessary to allow unimpeded progress of the prong through the well while the block is in its compressed state.

The spur module 45 can further comprise a threaded receptacle 55 mounted within the cavity 47 in the block 46. The poker 50 can further comprise a correspondingly threaded base 56 engaging the receptacle. The base can having a keyed bottom orifice 57 for being engaged by a tool such as an allen wrench. The cavity can include a bottom aperture through which the tool can engage the orifice. Thus, while the block is in an uncompressed state, the vertical location of the prong 51 within the well 48 can be adjusted by engaging a tool in the keyed orifice and rotating the tool. In this embodiment the prong can be connected to a threaded bolt engaging a correspondingly threaded receptacle mounted to the block at the base of the cavity.

In other words, the amount of force F required to cause the tip 53 of the prong 51 to penetrate through the aperture 49 can be adjusted by turning the base 35 in and out of the threaded receptacle 33 thereby changing the relative axial position of the prong within the well. If the distance D is large, it will take a large force to compress the block 46 enough to cause the prong tip to penetrate through the aperture. Likewise, if the distance is small, the force required for contact will be small. In this way the spur module 45 can include a poker 50 oriented to press against the user's foot upon a sufficient force exerted upon an undersurface of the insole 42 opposite the foot which counters the force F caused by the user's weight.

In this way, the block 46 of compressible material becomes a means for sensing the force or pressure on the foot of the user. By selecting a predetermined position of the prong beneath the foot of the user, the pressure sensing means can be adjustable.

It shall be understood that the entire poker 50 can be removed and replaced with a replacement poker have a longer or shorter prong, and a sharper or more blunted tip depending on the needs of the user.

It shall be understood that the upper surface 43 of the block 46 can be readily covered with a thin, flexible sheet of fabric or other material which will protect the cavity from fouling with debris while also allowing free movement of the prong tip 53 above the upper surface.

It shall be understood that although the prong 51 and well 48 in this embodiment have a substantially cylindrical shape, those skilled in the art will readily appreciate that other shapes can be adequately employed.

Figure 8:
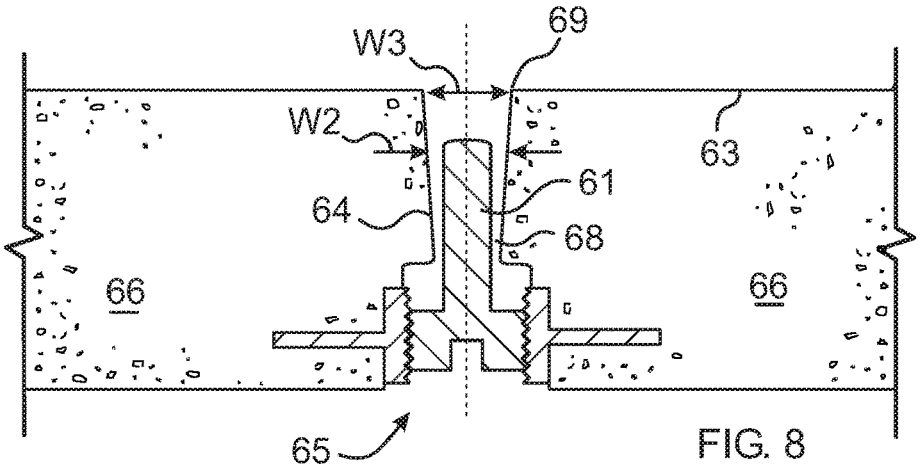
FIG. 8 is a diagrammatic cross-sectional side view of an alternate spur module having a conical well.

Further, as shown in FIG. 8, in an alternate embodiment, the spur module 65 can be made have a well 68 that has a substantially conically shaped sidewall 64 where the width W2 in an axially medial section is significantly smaller than the width W3 at the upper aperture 69 of the well. Because the block 66 can be made from a material which does not compress linearly but rather compresses to a greater degree at its surface 63, the sidewall will correspondingly collapse radially inwardly more near the upper aperture than axially further down the well. This would lead to a narrowing of width W3 to a greater degree than the narrowing of width W2. By providing a conically shaped well, this non-linear collapse is accommodated and movement of the prong 61 will be unimpeded.

It shall be understood that aversion therapy to avoid providing too much weight on a user's foot can be accomplished using the above-described device in absence of a shoe. In this way the patient can lay in bed and need not remember to put on the device. By placing the device in the sock the device is always in position to make aversion contact with the user should those conditions arise. Further, when all weight is completely off the foot, the flexibility of the sock material allows the device to be at rest without providing any significant or noticeable pressure to the heel. Thus, the patient has essentially no sensation of the device while in the supine position.

In this way, the invention, in both of the above-described embodiments, offer a simple, inexpensive, easy to adjust mechanism for promoting aversion therapy in absence of any electronics. No specialized force-sensing means are necessary.

While the preferred embodiments of the invention have been described, modifications can be made and other embodiments may be devised without departing from the spirit of the invention and the scope of the appended claims.

What is claimed is:

1. A combination of a fabric sock shaped and dimensioned to be worn on a user's foot, and an aversion therapy insole, wherein said insole comprises:

a spur module fixed with respect to a sole portion of said sock;

wherein said spur module comprises:

a first poker oriented to press against the user's foot upon a sufficient force exerted upon an undersurface of said insole opposite said foot;

means for replacing said first poker having a first durometer with a second poker having a second durometer different from said first durometer.

2. The combination of claim 1, wherein said first durometer is at least 40 A on the Shore durometer scale.

3. The combination of claim 2, wherein said first poker comprises a convex surface oriented to press against a user's heel during use.

4. The combination of claim 2, wherein said first poker comprises an insert contained within a pocket formed on an inside surface of said sole portion.

5. The combination of claim 2, wherein said spur module comprises an adhesive band carrying said first poker.

6. The combination of claim 5, wherein said adhesive band comprises a medial depression shaped and dimensioned to nest said first poker therein.

7. The combination of claim 2, wherein said first poker is oriented to contact said user's foot in absence of a shoe.

8. A device for training a person to avoid placing an undesirable amount of weight on their foot, said devices comprises:

a fabric sock shaped and dimensioned to be worn over a person's foot; and, a spur module fixed with respect to a sole portion of said sock;

wherein said spur module comprises:

a block of resiliently compressible material having an upper surface exposed to said persons foot;

a cavity within said block having an upper aperture;

a poker comprising an upwardly projecting blunted prong having a tip portion shaped to pass through said upper aperture.

9. The device of claim 8, wherein said tip is located at a predetermined vertical position spaced a distance apart from said upper surface while said block is uncompressed.

10. The device of claim 8, wherein said block is shaped and dimensioned to form an insole within said sock.

11. The device of claim 8, wherein said cavity comprises and conical well.

12. The device of claim 8, wherein an axial position of said prong is adjustable.

13. The device of claim 12, wherein said poker comprises a threaded base threadedly engaged within a threaded receptacle fixed to said spur module.

14. A method for training a user to avoid high stress walking, said method comprises:

inserting a spur module within a sock;

locating said spur module in the sole portion of said sock;

wearing said sock upon a foot of said user;

engaging in high stress walking by said user;

activating said spur module in response to said engaging;

wherein said activating comprises:

forcing a poker into the sole of the foot of said user;

replacing a first poker having a first durometer with a second poker having a second durometer different from said first durometer.

* * * * *